US005922658A

United States Patent [19]

Duncan et al.

[11] Patent Number: 5,922,658

[45] **Date of Patent: *Jul. 13, 1999**

[54] TWO-CYCLE ENGINE OIL FORMED FROM A BLEND OF A COMPLEX ALCOHOL ESTER AND OTHER BASESTOCKS

[75] Inventors: Carolyn Boggus Duncan; David Wayne Turner, both of Baton Rouge, La.

[73] Assignee: Exxon Chemical Patents Inc., Houston, Tex.

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/799,012

[22] Filed: Feb. 7, 1997

Related U.S. Application Data

[60] Provisional application No. 60/025,596, Sep. 6, 1996.

[51] Int. Cl.[6] ..... C10M 129/78; C10L 1/18

[52] U.S. Cl. ..... 508/492; 508/485; 44/398

[58] Field of Search ..... 508/492, 485; 44/398

[56] References Cited

U.S. PATENT DOCUMENTS

| | | | |
|---|---|---|---|
| 2,628,974 | 2/1953 | Sanderson | 508/492 |
| 2,805,247 | 9/1957 | Krischai | 560/199 |
| 2,884,399 | 4/1959 | Barnart et al. | 524/285 |
| 3,016,353 | 1/1962 | Matuszak | 508/494 |
| 3,048,623 | 8/1962 | Matuszak et al. | 560/199 |
| 3,148,200 | 9/1964 | Mills et al. | 560/89 |
| 3,194,764 | 7/1965 | Ovist et al. | 508/492 |
| 3,202,701 | 8/1965 | Young et al. | 508/492 |
| 3,278,586 | 10/1966 | Ovist et al. | 508/492 |
| 3,360,546 | 12/1967 | Hequembourg | 560/191 |
| 3,377,377 | 4/1968 | Kluge | 508/494 |
| 3,697,428 | 10/1972 | Meinhardt et al. | 508/492 |
| 3,857,865 | 12/1974 | Sturwold et al. | 508/492 |
| 3,888,909 | 6/1975 | Dieterman et al. | 560/90 |
| 3,956,220 | 5/1976 | Riem et al. | 524/295 |
| 3,984,445 | 10/1976 | Takeo et al. | 560/199 |
| 4,036,771 | 7/1977 | Denis et al. | 508/494 |
| 4,155,861 | 5/1979 | Schmitt et al. | 508/492 |
| 4,968,452 | 11/1990 | Seiki | 508/485 |
| 4,994,196 | 2/1991 | Kagaya et al. | 508/485 |
| 5,057,247 | 10/1991 | Schmid et al. | 508/492 |
| 5,314,634 | 5/1994 | Kenbeek et al. | 508/492 |
| 5,372,736 | 12/1994 | Trivett | 252/56 |
| 5,411,672 | 5/1995 | Kagaya et al. | 508/492 |
| 5,503,762 | 4/1996 | Bongardt et al. | 508/492 |
| 5,560,850 | 10/1996 | Hoppe et al. | 508/485 |
| 5,562,867 | 10/1996 | Tiffany, III et al. | 44/398 |
| 5,658,863 | 8/1997 | Duncan et al. | 508/485 |
| 5,750,750 | 5/1998 | Duncan et al. | 554/117 |

FOREIGN PATENT DOCUMENTS

| | | |
|---|---|---|
| 736513 | 6/1966 | Canada . |
| 182526 | 5/1986 | European Pat. Off. . |
| 0335013 | 10/1989 | European Pat. Off. . |
| 0 568 348 | 11/1993 | European Pat. Off. . |
| 2307867 | 11/1976 | France . |
| 2511905 | 9/1975 | Germany . |
| 70004740 | 1/1965 | Japan . |
| 72042821 | 10/1972 | Japan . |
| 60-045547 | 3/1985 | Japan . |
| 60-056657 | 3/1985 | Japan . |
| 62-045561 | 2/1987 | Japan . |
| 63-107947 | 5/1988 | Japan . |
| 03217493 | 9/1991 | Japan . |
| 05025484 | 2/1993 | Japan . |
| 06025682 | 2/1994 | Japan . |
| 06025683 | 2/1994 | Japan . |
| 7330670 | 12/1995 | Japan . |
| 6408397 | 1/1966 | Netherlands . |
| 1060750 | 3/1967 | United Kingdom . |
| 1460665 | 1/1977 | United Kingdom . |
| 1526825 | 10/1978 | United Kingdom . |
| 9617910 | 6/1996 | WIPO . |

OTHER PUBLICATIONS

Abstract of Japanese Patent Publication No. 69 JP–0056419, Jul. 18, 1969.

Abstract of"A Route to Quantitative Carbon–13 NMR Analysis of Multicomponent Polyesters", Hvilsted, S., Makromol. Chem., Macromol. Symp. 1991.

Abstract of"Composite Ester Plasticizers", Matsumoto et al., Kobunshi Ronbunshu (1990) 47(3), 177–84.

(List continued on next page.)

pp. 271–289.

*Primary Examiner*—Ellen M. McAvoy
*Attorney, Agent, or Firm*—Blossom E. Loo

[57] ABSTRACT

A biodegradable two-cycle lubricant which is prepared from an add mixture of: (1) a biodegradable lubricating oil comprising an add mixture of the following components: a complex alcohol ester basestock which comprises the reaction product of an add mixture of the following: a polyhydroxyl compound represented by the general formula:

$$R(OH)_n$$

wherein R is any aliphatic or cyclo-aliphatic hydrocarbyl group and n is at least 2, provided that the hydrocarbyl group contains from about 2 to 20 carbon atoms; a polybasic acid or an anhydride of a polybasic acid, provided that the ratio of equivalents of the polybasic acid to equivalents of alcohol from the polyhydroxyl compound is in the range between about 1.6:1 to 2:1; and a monohydric alcohol, provided that the ratio of equivalents of the monohydric alcohol to equivalents of the polybasic acid is in the range between about 0.84:1 to 1.2:1; wherein the complex alcohol ester exhibits a viscosity in the range between about 100–700 cSt at 40° C. and has a polybasic acid ester concentration of less than or equal to 70 wt. %, based on the complex alcohol ester; and at least one additional basestock, wherein the biodegradable lubricating oil exhibits biodegradability of greater than 60% as measured by the Sturm test; and (2) an additive package.

35 Claims, No Drawings

OTHER PUBLICATIONS

Beilstein Handbook of Organic Chemistry (1994), Molecular Formula C12 H14 O8, CAS RN 88299–27–8.
Beilstein Handbook of Organic Chemistry (1994), Molecular Formula C14 H18 O8, CAS RN 17669–36–2.
Beilstein Handbook of Organic Chemistry (1994), Molecular Formula C14 H18 O8.
Beilstein Handbook of Organic Chemistry, Molecular Formula C16 H22 O8, CAS RN 52298–30–3.
Beilstein Handbook of Organic Chemistry (1994), Molecular Formula C16 H22 O8.
Beilstein Handbook of Organic Chemistry (1994), Molecular Formula C20 H30 O8, CAS RN 6286–34–6.
Beilstein Handbook of Organic Chemistry (1994), Molecular Formula C24 H22 08, CAS RN 25737–43–3.
Beilstein Handbook of Organic Chemistry (1994), Molecular Formula C25 H28 O12, CAS RN 122947–40–4.
Beilstein Handbook of Organic Chemistry (1994), Molecular Formula C26 H30 O12, CAS RN 122947–41–5.
Beilstein Handbook of Organic Chemistry (1994), Molecular Formula C27 H32 O12, CAS RN 122947–42–6.
Beilstein Handbook of Organic Chemistry (1994), Molecular Formula C27 H44 O15, CAS RN 2985–19–5.
Beilstein Handbook of Organic Chemistry (1994), Molecular Formula C27 H48 O10.
Beilstein Handbook of Organic Chemistry (1994), Molecular Formula C28 H42 O17.
Beilstein Handbook of Organic Chemistry (1994), Molecular Formula C28 H42 O24.
Beilstein Handbook of Organic Chemistry (1994), Molecular Formula C32 H50 O17.
Beilstein Handbook of Organic Chemistry (1994), Molecular Formula C32 H58 O10.
Beilstein Handbook of Organic Chemistry (1994), Molecular Formula C33 H56 O15, CAS RN 2985–21–9.
Beilstein Handbook of Organic Chemistry (1994), Molecular Formula C35 H64 O8, CAS RN 53832–30–7.
Beilstein Handbook of Organic Chemistry (1994), Molecular Formula C36 H54 O30.
Beilstein Handbook of Organic Chemistry (1994), Molecular Formula C38 H70 O8, CAS RN 55205–81–7.
Beilstein Handbook of Organic Chemistry (1994), Molecular Formula C39 H68 O15, CAS RN 2985–20–8.
Beilstein Handbook of Organic Chemistry (1994), Molecular Formula C42 H66 O22.
Beilstein Handbook of Organic Chemistry (1994), Molecular Formula C45 H68 O36, CAS RN 96961–13–6.
Beilstein Handbook of Organic Chemistry (1994), Molecular Formula C45 H80 O15, CAS RN 2985–22–0,.
Beilstein Handbook of Organic Chemistry (1994), Molecular Formula C48 H74 O25.
Beilstein Handbook of Organic Chemistry (1994), Molecular Formula C54 H98 O12, CAS RN 55205–82–8.
Beilstein Handbook of Organic Chemistry (1994), Molecular Formula C56 H86 O29.
Beilstein Handbook of Organic Chemistry (1994), Molecular Formula C58 H90 O30.
Beilstein Handbook of Organic Chemistry (1994), Molecular Formula C64 H98 O33.
Abstract of JP Patent Pub. 86JP–0254403 861024.
Abstract of JP Patent Pub. 86JP–0157184 860705.
Abstract of JP Patent Pub. 85JP–0185032 850824.
Abstract of JP Patent Pub. 72JP–0056806 720609.
Abstract of JP Patent Pub. 84JP–0196772 840921.

*A Route To Quantitative carbon–13 NMR Analysis Of Multicomponent Polyesters* by Soeren Hvilsted; Makromel Chem., Macromol. Symp. 1991, 177–184.
*Carbon–13 NMR Analysis of Crosslinking Sites In Branched Polyesters* by Soeren Hvilsted; Biol. Synth. Polym. Networks, 1988, 243–54.
*Reactive Oligomers. 5. Polymerization of Ethylene Glycol Bis(isopropyl fumarate), ethylene glycol bis(n–butyl fumarate), and diethylene glycol bis(n–butyl fumarate* by Akira Matsumoto et al.; J. Polym. Sci. Part a: Polym. Chem, 1988.
*Reactive Oligomers. I. Preparation and Polymerization of Ethylene Glycol Bis(methyl fumarate)*; Akira Matsumoto et al.; J. Polym. Sci. Polym. Chem. Ed., 1983, 21(11).
*Reactive Oligomers With Triple Bonds. II. Synthesis And Study of the Properties of Oligoester Propargyl Esters*; S.G. Grigoryan et al; Am. Khim. Zh., 1979, 32(11), 911–14.
*Effect of Number of Carboxyl Groups on Liquid Density of Esters of Alkylcarboxylic Acids*; Joseph C. Phillips; J. Chem. Eng. Data, 1978, 23(1), 1–6.
*Pyrolysis of poly(1,4–butylene adipatae)*; Francois Messier et al.; Can. J. Chem., 1977, 55(14).
*Correlation of Liquid Heat–Capacities for Carboxylic Esters*; Joseph C. Phillips, et al.; J. Chem. Eng. Data, 1976 21(2), 228–32.
*Liquid (melt) Heat Capacities and Heats of Vaporization of Oligomers of Poly(hesamethylene sebacate)*; J.C. Phillips; Polym. Eng. Sci., 1975, 15(2), 73–8.
*Mass Spectra and Qualitative Analysis of Esters of Aliphatic Dicarboxylic Acids*; L.N. Sosulina; Zh. Org. Khimm, 1974, 10(7), 1350–5.
*Lubricants for Precision Mechanisms*; A.K. Misra et al.; Proc. World Conf. Ind. Tribol., 1973.
*New Lubricants. Esters and Polyesters of Pentaerythritol*; Witold Pawlowski et al., Przem. Chem., 1974, 51(8).
*Mixed Esters of 1,10–decanedicarboxylic acid*; I.A. Volkova et al; Zh. Prikl, Khim. (Leningrad) 1972; 45(4).
*Substances Contained in Polyesters of the System Triol–monool–dicarboxylic Acid*; R. Schoellner; Plaste kaut, 1968, 15(3).
*New Derivatives of Pentaerythritol*; Bela Zsadon et al.; Magyar Kem. Folybiral 65, 253–6, 1959.
*Light–switched Chromophoric Device Designed From an Ionophoric Calix[4]arene*; Gang Deng et al.; J. Polym. Sci., Part a: Polym. Chem., 1993, 31(7).
*Photoimaging Composition Containing Oligomer Maleic Acid Ester and Fumaric Acid Ester for Preparation of Relief Printing Plates*: Joachim Gersdorf; Ger. Offen., 8 pp.
*Mixed Esters for Plasticizers for Poly(vinyl chloride)*; Tetsu Matsumoto; Jpn. Kokai Tokkyo Koho, 7pp.
*Diol Alkenyl Fumarates for Preparation of Highly Crosslinked Polymers*; Tkayuki Otsu et al.; Jpn. Kokai Tokkyo Koho, 6.
*Diol Bis(alkyl fumaate) Compounds*; Masayoshi Oiwa; Jpn. Kokai Tokkyo Koho, 7 pp.
*Polyol Poly(allylesters)*; Masaaki Oba et al.; Japan. Kokai, 4 pp.
*Complex Ester Plasticizers and Lubricants*; Tetsu Matsumoto; Jpn. Kokai Tokkyo Koho, 11 pp.
*Effect of Small Amounts of the Plasticizer Propylene Glycol Adipate Dibutyl Ester on the High–speed Extrusion of Rigid PVC*; H.R. Vargas et al.; Rev. Plast. Mod., 1986, 51(360).
*Membrane Manufacturing Method*; Inorganic Analytical Chemistry.
*Refrigerator Working Fluid Compositions*; Fossil Fuels, Derivatives and Related Products.

*Liquid Compositions Containing Carboxylic (poly)esters*; Industrial Organic Chemicals, Leather, Fats and Waxes.
*Multisensor array for pH, Potassium(l+), sodium(l+) and calcium(2+) Measurements based on Coated–film Electrodes*; Inorganic Analytical Chemistry.
*Study of the Surface Activity of Dialkyl Disulfossuccinoethane Salts*; Surface Active Agents and Detergents.
*Multisensor Aray for pH, Potassium(l+); Sodium(l+) and Calcium(2+) Measurements Based on Coated–film Electrodes*; Inorganic Analytical Chemistry.
*Study of the Surface Activity of Dialkyl Disulfosuccionoethane Salts*; Plastics Manufacture and Processing.
*Polyester Plasticizers Containing Trimellitate Ester Mixtures*; Plastics Manufacture and Processing.
*Lubricants Containing Crosslinked Esters for Processing Thermoplastic Synthetic Fibers*; Textiles and Fibers.
*Lubricants Containing Ester–Olefin Reaction Products for Processing Thermoplastic Synthetic Fibers*; Textiles and Fibers.
*Lubricants Containing Ester Polymers for Processing Thermoplastic Synthetic Fibers*; Textiles and Fibers.
*Active Methylene Compounds and Receptors as Curing Systems for Coatings*; Coatings, Inks, and Related Products.
*Stretchable Polyethylene Films*; Plastics Manufacture and Processing.
*Potentiometric Method and Apparatus for Determining the Concentration Ratio of Lithium to Sodium Ions*; Inorganic Analytical Chemistry.
*Dicarboxylic Acid Diamides, Method for Producing Them, Their Sodium Complexes, and Ion–Selective Components for Determing Sodium Complexes*; Inorganic Analytical Chemistry.
*Photocured Polymers In Ion–selective Electrode Membranes, Part I. A Potassium Electrode for Flow–Injection Analysis*; Inorganic Analytical Chemistry.
*Stabilizers for Halogen–containing Polymers Comprising the Product of a Diorganotin Oxide, an Ethylenically Unsaturated Dicarboxylic Acid Ester and a Mercaptan*; Plastics Manufacture and Processing.
*Esterification and/or Ester Interchange Catalyst*; Industrial Organic Chemicals, Leather, Fats and Waxes.
*Bicarbonate–sensitive Electrode Based on Planar Thin Membrane Technology*; Inorganic Analytical Chemistry.
*Selective transport Membranes and Their Applicability for Novel Sensors*; Electrochemistry.
*Design of Neutral Hydrogen Ion Carriers for Solvent Polymeric Membrane Electrodes of Selected pH Range*; Inorganic Analytical Chemistry.
*Radical Copolymerization of Ethylene Glycol Bis(methyl fumarate) with N–vinylcarbazole*; Chemistry of Synthetic High Polymers.
*Stabilizers for PVC*; Plastics Manfacture and Processing.
*Bis(progargyloxymaleoyloxy)ethane as an Antiwear Additive for Spindle or Transformer Oil*; Fossil Fuels, Derivatives, and Related Products.
*Fiber Finishing Agents*; Textiles.
*Lubricant Finishes for Synthetic Fibers*; Textiles.
*Reactive Oligomers. II. Polymerization of Glycol (bis–allylphthalate)s and Glycol bis(allyl succinate)s*; Chemistry of Synthetic High Polymers.
*Synthesis of Vinyl Oligoesters*; Chemistry of Synthetic High Polymers.
*Easily Crosslinkable Polymer Material*; Plastics Manufacture and Processing.
*Readily–crosslinked Plastics*; Plastics Manufacture and Processing.
*Foam Plastics*; Plastics Manufacture and Processing.
*Synthesis of Unsaturated Polyesters Based on Dicyclopentadiene Derivatives*; Plastics Manufacture and Processing.
*Plasticizers for Vinyl Polymers and Nylon 12*; Plastics Manufacture and Processing.
*Poly(vinyl chloride) Mixture and Its Fcopolymers Resistant Against Organic Aliphatic Solvents, Oils and Low Temperature*; Plastics Manufacture and Processing.
*Effect of Polyester Plasticizers on the Radiation Crosslinking of a PVC–triallyl Cyanurate Composition*; Plastics Manufacture and Processing.
*Antifriction Grease*; Petroleum, Petroleum Derivatives, and Related Products.
*Light–resistant Polypropylene Filmaments*; Textiles.
*2–Propynyl Bisesters*; Noncondensed Aromatic Compounds.
*Novel Polyallyl Esters, Their Production and Use*; Plastics Manufacture and Processing.
*Odorless Acrylic Adhesives*; Plastics Fabrication and Uses.
*Complex Esters As Antiwear Agents* by Misra; et al.; dated Apr. 26, 1973, pp. 229–237.
*Journal of Applied Chemistry of the USSR*; Sep., 1972, vol. 45, No. 4, Part 2; 3 pages.
*Synthetic Lubricants And High–Performance Functional Fluids*, by Ronald L. Shubkin, pp. 41 & 64.
*Synthesis, Evaluation and Appications of Complex Esters As Lubricants: A Basic Study*; by P.S. Venkataramani et al., JSL,

TWO-CYCLE ENGINE OIL FORMED FROM A BLEND OF A COMPLEX ALCOHOL ESTER AND OTHER BASESTOCKS

This application claims priority to U.S. Provisional Patent Application No. 60/025,596 filed Sep. 6, 1996.

The present invention relates generally to blends of natural, hydrocarbon-based and synthetic lubricant basestocks with high viscosity complex alcohol esters for use as a biodegradable two-cycle engine oil. These blended lubricating oils when additized with different adpacks, can achieve the performance requirements of a TC-W3 two-cycle engine oil. When the complex alcohol esters are blended with basestocks such as natural, hydrocarbon-based and/or synthetic esters, then the following performance improvements are seen: wide range of viscosities for various iso-grade applications, good low temperature properties, excellent lubricity, seal's compatibility, good oxidative and thermal stability, good biodegradability (i.e., at least 60% biodegradation as measured by the Modified Sturm test (OECD 301B) or Manometric Respirometer (OECD 301F)), and very low toxicity.

BACKGROUND OF THE INVENTION

The interest in developing biodegradable lubricants for use in applications which result in the dispersion of such lubricants into waterways, such as rivers, oceans and lakes, has generated substantial interest by both the environmental community and lubricant manufacturers. The synthesis of a lubricant which maintains its cold-flow properties and additive solubility without loss of biodegradation or lubrication would be highly desirable.

Basestocks for biodegradable two-cycle lubricants should typically meet five criteria: (1) solubility with dispersants and other additives such as polyamides; (2) good cold flow properties (such as, less than −40° C. pour point and less than 7500 cps at −25° C.); (3) sufficient biodegradability to off-set the low biodegradability of any dispersants and/or other additives to the formulated lubricant; (4) good lubricity without the aid of wear additives; and (5) very low toxicity of greater than 1,000 ppm.

The Organization for Economic Cooperation and Development (OECD) issued draft test guidelines for degradation and accumulation testing in December 1979. The Expert Group recommended that the following tests should be used to determine the "ready biodegradability" of organic chemicals: Modified OECD Screening Test, Modified MITI Test (I), Closed Bottle Test, Modified Sturm Test, the Modified AFNOR Test, and the Manometric Respirometer Test. The Group also recommended that the following "pass levels" of biodegradation, obtained within 28 days, may be regarded as good evidence of "ready biodegradability": (Dissolved Organic Carbon (DOC)) 70%; (Biological Oxygen Demand (BOD)) 60%; (Total Organic Carbon (TOD)) 60%; ($CO_2$) 60%; (DOC) 70%; and ($O_2$ consumption) 60%, respectively, for the tests listed above. Therefore, the "pass level" of biodegradation, obtained within 28 days, using the Modified Sturm Test is at least ($CO_2$) 60% and the Manometric Respirometer is at least ($O_2$) 60%.

The OECD guideline for testing the "ready biodegradability" of chemicals under the Modified Sturm test (OECD 301B, adopted May 12, 1981, and which is incorporated herein by reference) involves the measurement of the amount of $CO_2$ produced by the microorganisms during the degradation of the test compound which is measured and expressed as a percent of the theoretical $CO_2$ ($ThCO_2$) it should have produced calculated from the carbon content of the test compound. Biodegradability is therefore expressed as a percentage of $ThCO_2$. The Modified Sturm test is run by spiking a chemically defined liquid medium, essentially free of other organic carbon sources, with the test material and inoculated with sewage micro-organisms. The $CO_2$ released is trapped as $BaCO_3$. After reference to suitable blank controls, the total amount of $CO_2$ produced by the test compound is determined for the test period and calculated as the percentage of total $CO_2$ that the test material could have theoretically produced based on carbon composition. See G. van der Waal and D. Kenbeek, "Testing, Application, and Future Development of Environmentally Friendly Ester Based Fluids", *Journal of Synthetic Lubrication*, Vol. 10, Issue No. 1, April 1993, pp. 67–83, which is incorporated herein by reference.

The OECD guideline for testing the "ready biodegradability" of chemicals under the Manometric Respirometer test (OECD 301F, adopted Jul. 17, 1992, and which is incorporated herein by reference) involves the measurement of the amount of $O_2$ consumed by the microorganisms during the biodegradation of the test compound. It is measured and expressed as a percent of the theoretical $O_2$ demand (ThOD) it should have consumed calculated from the carbon content of the test compound. Biodegradability is therefore expressed as a percentage of ThOD. The Manometric Respirometer test is run by spiking a chemically defined liquid medium, essentially free of other organic carbon sources, with the test material and inoculated with sewage microorganisms. The oxygen consumed is determined either by measuring the amount of oxygen (produced electrolytically) required to maintain constant gas volume in the respirometer flask, or from the change in volume or pressure (or a combination of the two) in the apparatus. After reference to suitable blank controls, the total amount of oxygen consumed by the microorganisms is determined for the test period and calculated as the percentage of total oxygen demand that the microorganisms would have theoretically required to biodegrade the test compound based on carbon composition. See "OECD Guidelines for the Testing of Chemicals", Vol. 1, OECD 1993.

One basestock in current use today is rapeseed oil (i.e., a triglyceride of fatty acids, e.g., 7% saturated $C_{12}$ to $C_{18}$ acids, 50% oleic acid, 36% linoleic acid and 7% linolenic acid), having the following properties: a viscosity at 40° C. of 47.8 cSt, a pour point of 0° C., a flash point of 162° C. and a biodegradability of 85% by the Modified Sturm test. Although it has very good biodegradability, its use in biodegradable lubricant applications is limited due to its poor low temperature properties and poor stability.

Unless they are sufficiently low in molecular weight, esters synthesized from both linear acids and linear alcohols tend to have poor low temperature properties. Even when synthesized from linear acids and highly branched alcohols, such as polyol esters of linear acids, high viscosity esters with good low temperature properties can be difficult to achieve. In addition, pentaerythritol esters of linear acids exhibit poor solubility with dispersants such as polyamides, and trimethylolpropane esters of low molecular weight (i.e., having a carbon number less than 14) linear acids do not provide sufficient lubricity. This lower quality of lubricity is also seen with adipate esters of branched alcohols. Since low molecular weight linear esters also have low viscosities, some degree of branching is required to build viscosity while maintaining good cold flow properties. When both the alcohol and acid portions of the ester are highly branched, however, such as with the case of polyol esters of highly branched oxo acids, the resulting molecule tends to exhibit poor biodegradation as measured by the Modified Sturm test (OECD Test No. 301B).

In an article by Randles and Wright, "Environmentally Considerate Ester Lubricants for the Automotive and Engineering Industries", *Journal of Synthetic Lubrication*, Vol. 9-2, pp. 145–161, it was stated that the main features which slow or reduce microbial breakdown are the extent of branching, which reduces β-oxidation, and the degree to which ester hydrolysis is inhibited. The negative effect on biodegradability due to branching along the carbon chain is further discussed in a book by R. D. Swisher, "Surfactant Biodegradation", Marcel Dekker, Inc., Second Edition, 1987, pp. 415–417. In his book, Swisher stated that "The results clearly showed increased resistance to biodegradation with increased branching . . . . Although the effect of a single methyl branch in an otherwise linear molecule is barely noticeable, increased resistance [to biodegradation] with increased branching is generally observed, and resistance becomes exceptionally great when quaternary branching occurs at all chain ends in the molecule." The negative effect of alkyl branching on biodegradability was also discussed in an article by N. S. Battersby, S. E. Pack, and R. J. Watkinson, "A Correlation Between the Biodegradability of Oil Products in the CEC-L-33-T-82 and Modified Sturm Tests", Chemosphere, 24(12), pp. 1989–2000 (1992).

Initially, the poor biodegradation of branched polyol esters was believed to be a consequence of the branching and, to a lesser extent, to the insolubility of the molecule in water. However, recent work by the present inventors has shown that the non-biodegradability of these branched esters is more a function of steric hindrance than of the micro-organism's inability to breakdown the tertiary and quaternary carbons. Thus, by relieving the steric hindrance around the ester linkage(s), biodegradation can more readily occur with branched esters.

Branched synthetic polyol esters have been used extensively in non-biodegradable applications, such as refrigeration lubricant applications, and have proven to be quite effective if 3,5,5-trimethylhexanoic acid is incorporated into the molecule at 25 molar percent or greater. However, trimethylhexanoic acid is not biodegradable as determined by the Modified Sturm test (OECD 301B), and the incorporation of 3,5,5-trimethylhexanoic acid, even at 25 molar percent, would drastically lower the biodegradation of the polyol ester due to the quaternary carbons contained therein and the resulting steric hindrance that the branching would cause.

Likewise, incorporation of trialkyl acetic acids (i.e., neo acids) into a polyol ester produces very useful refrigeration lubricants. These acids do not, however, biodegrade as determined by the Modified Sturm test (OECD 301B) and cannot be used to produce polyol esters for biodegradable applications. Polyol esters of all branched acids can be used as refrigeration oils as well. However, they do not rapidly biodegrade as determined by the Modified Sturm Test (OECD 301B) and, therefore, are not desirable for use in biodegradable applications.

Although polyol esters made from purely linear $C_5$ and $C_{10}$ acids for refrigeration applications would be biodegradable under the Modified Sturm test, they would not work as a lubricant in two-cycle engine applications because their viscosities would be too low and wear additives would be needed. It is extremely difficult to develop a lubricant basestock which is capable of exhibiting all of the various properties required for biodegradable lubricant applications, i.e., high viscosity, low pour point, oxidative stability and biodegradability as measured by the Modified Sturm test.

U.S. Pat. No. 4,826,633 (Carr et al.), which issued on May 2, 1989, discloses a synthetic ester lubricant basestock formed by reacting at least one of trimethylolpropane and monopentaerythritol with a mixture of aliphatic monocarboxylic acids. The mixture of acids includes straight-chain acids having from 5 to 10 carbon atoms and an iso-acid having from 6 to 10 carbon atoms, preferably iso-nonanoic acid (i.e., 3,5,5-trimethylhexanoic acid). This basestock is mixed with a conventional ester lubricant additive package to form a lubricant having a viscosity at 99° C. (210° F.) of at least 5.0 centistokes and a pour point of at least as low as −54° C. (−65° F.). This lubricant is particularly useful in gas turbine engines. The Carr et al. patent differs from the present invention for two reasons. Firstly, it preferably uses as its branched acid 3,5,5-trimethylhexanoic acid which contains a quaternary carbon in every acid molecule. The incorporation of quaternary carbons within the 3,5,5-trimethylhexanoic acid inhibits biodegradation of the polyol ester product. Also, the lubricant according to Carr et al. exhibits high oxidative stability, as measured by a high pressure differential scanning calorimeter (HPDSC), i.e., about 35 to 65 minutes. This high stability is a result of the quaternary branching which increases the number of primary hydrogens (most stable) and decreases the number of secondary and tertiary hydrogens (less stable). The quaternary branching further increases stability by shielding the molecule (through steric hindrance) from attack by free radicals. However, the quaternary branching also shields the ester linkage making it difficult to impossible for microorganisms to attack the ester linkage, resulting in poor biodegradation. Conversely, the lubricant according to the present invention is lower in stability, i.e., it has a HPDSC reading of about 12–17 minutes. One reason for the lower stability is the fact that no more than 10% of the branched acids used to form the lubricant's ester basestock contain a quaternary carbon. The absence of quaternary carbons allows the micro-organisms to first attack the ester linkage and then the carbon-to-carbon bonds of the alcohol and acid moieties and effectively cause the ester to biodegrade.

The present inventors have discovered that blends of natural and synthetic lubricant basestocks with high viscosity complex alcohol esters unexpectedly provide a lubricating basestock having the following desirable properties: biodegradability, wide range of viscosities, low acid content, good pour point, excellent lubricity, seal compatibility, and low toxicity.

With the right ratios of polyol to polybasic acid to monohydric alcohol, complex alcohol esters can be produced which have reduced cost (approximately half the cost of complex acid esters), high viscosity (greater than 100 cSt at 40° C.), good thermal and oxidative stability, good biodegradability, low toxicity, good low temperature properties, and excellent lubricity. When blended with lower viscosity oils, a wide range of iso grade products can be produced which meet stringent end-use specifications. The present inventors have discovered that when the amount of linear monohydric alcohol exceeds 20% of the total alcohol used, then the pour point is too high, e.g., above −30° C. Furthermore, the present inventors have discovered that the ratio of polybasic acid to polyol is critical in the formation of a complex alcohol ester. That is, if this ratio is too low then a complex alcohol ester contains undesirable amounts of heavies which reduces biodegradability and increases the hydroxyl number of the ester which increases the corrosive nature of the resultant ester which is also undesirable. If, however, the ratio is too high then the resultant complex alcohol ester will have an undesirably low viscosity (reducing its applicability in certain iso grade applications) and poor seal swell characteristics.

The present inventors have also discovered that the ratio of the monohydric alcohol to polybasic acid is equally critical in the formation of complex alcohol esters. That is, if this ratio is too low then a complex alcohol ester contains undesirable amounts of heavies due to increased cross-linking which reduces biodegradation. It also increases the total acid number of the ester which increases the corrosive nature of the resultant ester and catalyzes the hydrolysis of the ester in the presence of water, both of which are undesirable. If, however, the ratio is too high, transesterification occurs producing more diester. The resultant complex alcohol ester will have an undesirably low viscosity (reducing its applicability in certain iso grade applications) and poor seal swell characteristics.

Other conventional natural and synthetic esters may each provide one or more of the desired attributes, e.g., high viscosity, good low temperature properties, biodegradability, lubricity, seal compatibility, low toxicity, and good thermal and oxidative stability, but none appears to be able to meet all of the product attributes by themselves. For example, some synthetic esters are capable of meeting the high viscosity property, but fail the biodegradability, low temperature requirements, or low toxicity requirements. Similarly, the natural basestocks such as rapeseed oil are capable of meeting the biodegradability and toxicity properties, but fail to meet the required high viscosity, lubricity, and thermal and oxidative stability properties.

The blended lubricant basestocks according to the present invention comprise a complex alcohol ester and at least one additional natural, hydrocarbon-based and/or synthetic basestock. These blends appear to satisfy all of the desired attributes for fully formulated two-cycle lubricant basestocks by providing the basestock with a unique level of biodegradability in conjunction with effective lubricating properties. They also provide excellent thermal and oxidative stability, good low temperature properties (i.e., low pour points), low toxicity, low volatility, and good seal compatibility.

Moreover, the present inventors have demonstrated that an unexpected, synergistic effect occurs when the complex alcohol esters of the present invention are blended with either a natural, hydrocarbon-based and/or synthetic ester basestock, i.e., the blended basestock unexpectedly exhibits enhanced product attributes versus either the complex alcohol ester or other basestock by itself. Thus, the blended basestocks according to the present invention exhibit the following attributes: excellent lubricity, seal compatibility, biodegradability, low toxicity, good low temperature properties, a wide viscosity range to meet various iso grade needs, good thermal and oxidative stability, and improved engine performance.

SUMMARY OF THE INVENTION

A biodegradable two-cycle lubricant which is prepared from an add mixture of: (1) a biodegradable lubricating oil comprising an add mixture of the following components: a complex alcohol ester basestock which comprises the reaction product of an add mixture of the following: a polyhydroxyl compound represented by the general formula:

$$R(OH)_n$$

wherein R is any aliphatic or cyclo-aliphatic hydrocarbyl group and n is at least 2, provided that the hydrocarbyl group contains from about 2 to 20 carbon atoms; a polybasic acid or an anhydride of a polybasic acid, provided that the ratio of equivalents of the polybasic acid to equivalents of alcohol from the polyhydroxyl compound is in the range between about 1.6:1 to 2:1; and a monohydric alcohol, provided that the ratio of equivalents of the monohydric alcohol to equivalents of the polybasic acid is in the range between about 0.84:1 to 1.2:1; wherein the complex alcohol ester exhibits a viscosity in the range between about 100–700 cSt at 40° C. and has a polybasic acid ester concentration of less than or equal to 70 wt. %, based on the complex alcohol ester; and at least one additional basestock, wherein the biodegradable lubricating oil exhibits biodegradability of greater than 60% as measured by the Sturm test; and (2) an additive package, wherein the two-cycle lubricating oil exhibits the following properties: excellent lubricity as determined by engine performance, Yamaha Tightening Tests, reduced valve sticking, or 4-ball wear; good stability as evidenced by the results of such tests as RBOT and HPDSC; and good low temperature performance.

In addition, when the second basestock is selected from the group consisting of: monoesters, diesters, polyol esters or natural esters, the two-cycle engine oil also exhibits (in addition to the above-mentioned properties) unexpected environmental performance as evidenced by tests such as the Modified Sturm Biodegradation test, no VOC's and low toxicity. Because the basestock components make up 75 to 85+% of the total formulations, the present inventors have found that the above tests' results are either completely controlled or significantly influenced by the right choices of basestock components. In addition, the present inventors have found that with varying ratios of two primary components, namely, the polyol ester of technical grade pentaerythritol and 50:50 wt. % ratio of iso-$C_8$, n-$C_8$ and n-$C_{10}$ acids and complex alcohol esters, most of the current specifications can be met without the aid of any additive and that the remaining specifications are so closely approached that only minimal additives are required to meet specifications.

The complex alcohol ester according to the present invention is preferably present in an amount between about 3 to 10 wt. %, more preferably between about 6 to 10 wt. %. When the complex alcohol ester is used in conjunction with other synthetic, hydrocarbon-based and/or natural esters, the complex alcohol ester is added primarily for lubricity and its biodegradability, and usually replaces or significantly reduces a metal extreme pressure (EP) wear additive such as one of the ZDDP family or replaces a lubricity additive such as PIB. In addition to engine performance credits, the resulting formulation has lower toxicity, lower costs and/or it can meet new industry specifications such as TC-W3 specifications in the two-cycle engine market. In these cases the complex alcohol ester is added primarily for its lubricity (coefficient of friction equal to or greater than 0.1) and biodegradability (greater than 60% after 28 days as measured by the Modified Sturm test). By using these two classes of components in varying concentrations, along with an additive package in the range of 10–20 wt. %, all properties important to two-cycle engine performance can be obtained, namely, viscosity at −25° C. less than 7,500 cps, total acid number less than 0.7 mgKOH/gram, passes engine performance such as Yamaha 2T Tightening test, biodegradability greater than 60% as measured by the Modified Sturm, and low toxicity (i.e., greater than 1,000 ppm). In addition, the over-all additive package can be formulated to minimize environmental impact due to the performance of the basestock blends. The resulting formulations offer equal or superior engine wear performance over existing formulations and little or no environmental impact.

When the lubricating basestock oil is comprised of a complex alcohol ester with a viscosity greater than 100 cSt at 40° C. and a hydrocarbon such as mineral oil, PAO, PIB, etc., then the basestock blend preferably exhibits sufficient lubricity to eliminate or significantly reduce the need for toxic extreme pressure wear additives such as ZDDP and other metal containing materials. When the lubricating oil is comprised of a complex alcohol ester with a viscosity greater than 100 cSt at 40° C. and a natural, hydrocarbon-based or synthetic ester, then the basestock blend preferably exhibits at least one of the properties selected from the group consisting of: (a) excellent lubricity as evidenced by the elimination or reduction of toxic extreme pressure wear additives; (b) good stability as evidenced by tests such as RBOT and HPDSC stability test; (c) good low temperature properties as evidenced by pour points less than −30° C. and −25° C. Brookfield viscosities of less than 8500 cps; (d) biodegradability of greater than 60% in 28 days as measured by the Sturm test; (e) low toxicity (greater than 1,000 ppm); (f) good seal compatibility; and (g) high flash point (greater than 200° C.) to reduce volatile organic components (VOC's).

The present invention also encompasses a hydrocarbon fuel which comprises an add mixture of: (1) a mogas (i.e., motor gasoline); (2) the aforementioned biodegradable lubricating oil; and (3) an additive package.

DESCRIPTION OF THE PREFERRED EMBODIMENTS

High viscosity complex alcohol esters provide a unique level of biodegradability in conjunction with effective lubricating properties even at low concentrations (i.e., less than 5 wt. %), especially designed for two-cycle engine applications. If the total acid number (TAN) and the di-ester content are low (i.e., less than 0.7 mgKOH/gram and less than 45 wt. %, respectively), and the esterification catalyst is effectively removed to a level of less than 25 ppm, high viscosity complex alcohol esters also provided excellent stability, good seal compatibility, and low toxicity. The present inventors have discovered that these unique high viscosity, low metals/low acid complex alcohol esters, when blended with other natural, hydrocarbon-based and/or synthetic basestocks, result in lubricant basestocks which exhibit biodegradability, as measured by the Modified Strum test, and enhanced engine wear performance greater than expected based on the measured performance of either basestock alone.

The preferred lubricant according to the present invention is a blend of the described complex alcohol ester composition and at least one additional basestock selected from the group consisting of: mineral oils, highly refined mineral oils, poly alpha olefins (PAO), polyalkylene glycols (PAG), polyisobutylene (PIB), phosphate esters, silicone oils, diesters, polyol esters, and natural esters; and a lubricant additive package. Blended biodegradable two-cycle lubricants according to the present invention preferably include 3 to 10 wt. % complex alcohol ester and 90 to 97 wt. % of a second basestock selected from natural oils and synthetic esters, especially biodegradable esters.

When the complex alcohol ester basestock is added in an amount such that the biodegradable lubricating oil exhibits a lubricity, as measured by the coefficient of friction, of less than or equal to 0.15. Moreover, the biodegradable lubricating oil passes the Yamaha Tightening Test, exhibits a FZG of greater than about 12, and/or exhibits a wear scar diameter of less than or equal to 0.45 millimeters.

The additional basestock is preferably selected from (a) mineral oils which are at least one oil selected from the group consisting of: rapeseed oils, canola oils and sunflower oils; (b) hydrocarbon-based oils which are at least one oil selected from the group consisting of: mineral oils and highly refined mineral oils; and (c) synthetic oils which are at least one oil selected from the group consisting of: poly alpha olefins, polyalkylene glycols, polyisobutylenes, phosphate esters, silicone oils, diesters, polyol esters, and other synthetic esters.

The complex alcohol ester is present in an amount between about 3–10 wt. %, preferably between 6 to 10 wt. %, and the additional basestock is present in an amount between about 90 to 97 wt. %, preferably between 90 to 94 wt. %.

Complex Alcohol Esters

One preferred complex alcohol ester according to the present invention the reaction product of an add mixture of the following: a polyhydroxyl compound represented by the general formula:

$$R(OH)_n$$

wherein R is any aliphatic or cyclo-aliphatic hydrocarbyl group and n is at least 2, provided that the hydrocarbyl group contains from about 2 to 20 carbon atoms; a polybasic acid or an anhydride of a polybasic acid, provided that the ratio of equivalents of the polybasic acid to equivalents of alcohol from the polyhydroxyl compound is in the range between about 1.6:1 to 2:1; and a monohydric alcohol, provided that the ratio of equivalents of the monohydric alcohol to equivalents of the polybasic acid is in the range between about 0.84:1 to 1.2:1; wherein the complex alcohol ester exhibits a pour point of less than or equal to −30° C., a viscosity in the range between about 100–700 cSt at 40° C., preferably 100–200 cSt, and having a polybasic acid ester concentration of less than or equal to 70 wt. %, based on the complex alcohol ester.

The present inventors have unexpectedly discovered that if the ratio of polybasic acid to polyol (i.e., polyhydroxyl compound) is too low, then an unacceptable amount of cross-linking occurs which results in very high viscosities, poor low temperature properties, poor biodegradability, and poor compatibility with other basestocks and with additives. If, however, the ratio of polybasic acid to polyol is too high, then an unacceptable amount of polybasic acid ester (e.g., adipate di-ester) is formed resulting in poor seal compatibility and low viscosity which limits the complex alcohol ester's applicability.

The present inventors have also discovered that if the ratio of monohydric alcohol to polybasic acid is too low, i.e., less than 0.96 to 1, then an unacceptably high acid number, sludge concentration, deposits, and corrosion occur. If, however, the ratio of monohydric alcohol to polybasic acid is too high (i.e., 1.2 to 1), then an unacceptable amount of polybasic acid ester is formed resulting in poor seal compatibility and low viscosity which limits the complex alcohol ester's applicability.

Moreover, the complex alcohol ester according to the present invention exhibits the following properties: lubricity, as measured by the coefficient of friction, of less than or equal to 0.1; a pour point of less than or equal to −30° C., preferably −40° C.; biodegradability of greater than 60%, as measured by the Sturm test (e.g., Modified Sturm test); an aquatic toxicity of greater than 1,000 ppm; no volatile organic components; and thermal/oxidative stability as measured by HPDSC at 220° C. and 3.445 MPa air of greater than 10 minutes with 0.5 wt. % of an antioxidant.

When the polyhydroxyl compound is at least one compound selected from the group consisting of: technical grade pentaerythritol and mono-pentaerythritol, then the ratio of equivalents of the polybasic acid to equivalents of alcohol from the polyhydroxyl compound is in the range between about 1.75:1 to 2:1.

When the polyhydroxyl compound is at least one compound selected from the group consisting of: trimethylolpropane, trimethylolethane and trimethylolbutane, then the ratio of equivalents of the polybasic acid to equivalents of alcohol from the polyhydroxyl compound is in the range between about 1.6:1 to 2:1.

When the polyhydroxyl compound is di-pentaerythritol, then the ratio of equivalents of the polybasic acid to equivalents of alcohol from the polyhydroxyl compound is in the range between about 1.83:1 to 2:1.

The monohydric alcohol may be at least one alcohol selected from the group consisting of: branched and linear $C_5$ to $C_{13}$ alcohol. The linear monohydric alcohol is preferably present in an amount between about 0 to 30 mole %, more preferably between about 5 to 20 mole %.

In a preferred embodiment, the monohydric alcohol is at least one alcohol selected from the group consisting of: $C_8$ to $C_{10}$ iso-oxo alcohols. Accordingly, one highly preferred complex alcohol ester is formed from the reaction product of the admixture of trimethylolpropane, adipic acid and either isodecyl alcohol or 2-ethylhexanol.

The unique complex alcohol esters according to the present invention preferably exhibit at least one of the properties selected from the group consisting of: (a) a total acid number of less than or equal to about 1.0 mgKOH/gram, (b) a hydroxyl number in the range between about 0 to 50 mgKOH/gram, (c) a metal catalyst content of less than about 25 ppm, (d) a molecular weight in the range between about 275 to 250,000 Daltons, (e) a seal swell equal to about diisotridecyladipate, (f) a viscosity at −25° C. of less than or equal to about 100,000 cps, (g) a flash point of greater than about 200° C., (h) aquatic toxicity of greater than about 1,000 ppm, (i) a specific gravity of less than about 1.0, and (j) a viscosity index equal to or greater than about 150.

It is particularly desirable to be able to control the stoichiometry in such a way so as to be able to manufacture the same product each time. Further, one wants to obtain acceptable reaction rates and to obtain high conversion with low final acidity and low final metals content. The present inventors have synthesized a composition and a method of production of that composition which provides a high viscosity oil having good low temperature properties, low metals, low acidity, high viscosity index, and acceptable rates of biodegradability as measured by the Modified Sturm test.

Of particular interest is the use of certain oxo-alcohols as finishing alcohols in the process of production of the desired materials. Oxo alcohols are manufactured via a process, whereby propylene and other olefins are oligomerized over a catalyst (e.g., a phosphoric acid on Kieselguhr clay) and then distilled to achieve various unsaturated (olefinic) streams largely comprising a single carbon number. These streams are then reacted under hydroformylation conditions using a cobalt carbonyl catalyst with synthesis gas (carbon monoxide and hydrogen) so as to produce a multi-isomer mix of aldehydes/alcohols. The mix of aldehydes/alcohols is then introduced to a hydrogenation reactor and hydrogenated to a mixture of branched alcohols comprising mostly alcohols of one carbon greater than the number of carbons in the feed olefin stream.

One particularly preferred oxo-alcohol is isodecyl alcohol, prepared from the corresponding $C_9$ olefin. When the alcohol is isodecyl alcohol, the polyol is trimethylolpropane and the acid is the $C_6$ diacid, e.g. adipic acid, a preferred complex alcohol ester is attained. The present inventors have surprisingly discovered that this complex alcohol ester, wherein the alcohol is a branched oxo-alcohol has a surprisingly high viscosity index of ca. 150 and is surprisingly biodegradable as defined by the Modified Sturm test. This complex alcohol ester can be prepared with a final acidity (TAN) of less than 0.7 mg KOH/gram and with a conversion of the adipic acid of greater than 99%. In order to achieve such a high conversion of adipic acid, a catalyst is required, and further, it is preferable to add the catalyst within a relatively narrow conversion window. Alternatively, the present inventors have discovered that the catalyst can also be added at anytime during the reaction product and removed to an amount of less than 25 ppm and still obtain a final acidity (TAN) of less than 0.7 mg KOH/gram, so long as the esterification reaction is followed by a hydrolysis step wherein water is added in an amount of between about 0.5 to 4 wt. %, based on crude esterification product, more preferably between about 2 to 3 wt. %, at elevated temperatures of between about 100 to 200° C., more preferably between about 125 to 175° C., and most preferably between about 140 to 160° C., and pressures greater than one atmosphere. Such high temperature hydrolysis can successfully remove the catalyst metals to less than 25 ppm without increasing the TAN to greater than 0.7 mgKOH/gram. The low metals and low acid levels achieved by use of this novel high temperature hydrolysis step is completely unexpected.

The present inventors have discovered that the actual product is a broad mix of molecular weights of esters and that, if so desired, an amount of diisodecyl adipate can be removed from the higher molecular weight ester via wipe film evaporation or other separation techniques if desired.

The present inventors have also discovered that highly stable complex alcohol esters can be produced that are resistant to viscosity increases during heating. This is accomplished by synthesizing complex alcohol esters with a low hydroxyl number by limiting the ratio of polybasic acid, polyol and monohydric alcohol. These highly stable complex alcohol esters exhibit no increase in viscosity when heated to temperatures above 200° C., while similar esters with high hydroxyl numbers increase in viscosity from 5 to 10% under similar conditions.

Monohydric Alcohols

Among the alcohols which can be reacted with the diacid and polyol are, by way of example, any $C_5$ to $C_{13}$ branched and/or linear monohydric alcohol selected from the group consisting of: isopentyl alcohol, n-pentyl alcohol, isohexyl alcohol, n-hexyl alcohol, isoheptyl alcohol, n-heptyl alcohol, iso-octyl alcohol (e.g., 2-ethyl hexanol or iso-octyl alcohol), n-octyl alcohol, iso-nonyl alcohol, n-nonyl alcohol, isodecyl alcohol, and n-decyl alcohol; provided that the amount of linear monohydric alcohol is present in the range between about 0–20 mole %, based on the total amount of monohydric alcohol.

One preferred class of monohydric alcohol is oxo alcohol. Oxo alcohols are manufactured via a process, whereby propylene and other olefins are oligomerized over a catalyst (e.g., a phosphoric acid on Kieselguhr clay) and then distilled to achieve various unsaturated (olefinic) streams largely comprising a single carbon number. These streams are then reacted under hydroformylation conditions using a cobalt carbonyl catalyst with synthesis gas (carbon monoxide and hydrogen) so as to produce a multi-isomer mix of aldehydes/alcohols. The mix of aldehydes/alcohols is then introduced to a hydrogenation reactor and hydrogenated to a mixture of branched alcohols comprising mostly alcohols of one carbon greater than the number of carbons in the feed olefin stream.

The branched oxo alcohols are preferably monohydric oxo alcohols which have a carbon number in the range between about $C_5$ to $C_{13}$. The most preferred monohydric oxo alcohols according to the present invention include iso-octyl alcohol, e.g., Exxal™ 8 alcohol, formed from the cobalt oxo process and 2-ethylhexanol which is formed from the rhodium oxo process.

The term "iso" is meant to convey a multiple isomer product made by the oxo process. It is desirable to have a branched oxo alcohol comprising multiple isomers, preferably more than 3 isomers, most preferably more than 5 isomers.

Branched oxo alcohols may be produced in the so called "oxo" process by hydroformylation of commercial branched $C_4$ to $C_{12}$ olefin fractions to a corresponding branched $C_5$ to $C_{13}$ alcohol/aldehyde-containing oxonation product. In the process for forming oxo alcohols it is desirable to form an alcohol/aldehyde intermediate from the oxonation product followed by conversion of the crude oxo alcohol/aldehyde product to an all oxo alcohol product.

The production of branched oxo alcohols from the cobalt catalyzed hydroformylation of an olefinic feedstream preferably comprises the following steps:

(a) hydroformylating an olefinic feedstream by reaction with carbon monoxide and hydrogen (i.e., synthesis gas) in the presence of a hydroformylation catalyst under reaction conditions that promote the formation of an alcohol/aldehyde-rich crude reaction product;

(b) demetalling the alcohol/aldehyde-rich crude reaction product to recover therefrom the hydroformylation catalyst and a substantially catalyst-free, alcohol/aldehyde-rich crude reaction product; and (c) hydrogenating the alcohol/aldehyde-rich crude reaction product in the presence of a hydrogenation catalyst (e.g., massive nickel catalyst) to produce an alcohol-rich reaction product.

The olefinic feedstream is preferably any $C_4$ to $C_{12}$ olefin, more preferably branched $C_7$ to $C_9$ olefins. Moreover, the olefinic feedstream is preferably a branched olefin, although a linear olefin which is capable of producing all branched oxo alcohols is also contemplated herein. The hydroformylation and subsequent hydrogenation in the presence of an alcohol-forming catalyst, is capable of producing branched $C_5$ to $C_{13}$ alcohols, more preferably branched $C_8$ alcohol (i.e., Exxal™ 8), branched $C_9$ alcohol (i.e., Exxal™ 9), and isodecyl alcohol. Each of the branched oxo $C_5$ to $C_{13}$ alcohols formed by the oxo process typically comprises, for example, a mixture of branched oxo alcohol isomers, e.g., Exxal™ 8 alcohol comprises a mixture of 3,5-dimethyl hexanol, 4,5-dimethyl hexanol, 3,4-dimethyl hexanol, 5-methyl heptanol, 4-methyl heptanol and a mixture of other methyl heptanols and dimethyl hexanols.

Any type of catalyst known to one of ordinary skill in the art which is capable of converting oxo aldehydes to oxo alcohols is contemplated by the present invention.

It is preferable that the linear monohydric alcohol be present in an amount between about 0 to 30 mole %, preferably between about 5 to 20 mole %.

Polyols

Among the polyols (i.e., polyhydroxyl compounds) which can be reacted with the diacid and monohydric alcohol are those represented by the general formula:

$$R(OH)_n$$

wherein R is any aliphatic or cyclo-aliphatic hydrocarbyl group (preferably an alkyl) and n is at least 2. The hydrocarbyl group may contain from about 2 to about 20 or more carbon atoms, and the hydrocarbyl group may also contain substituents such as chlorine, nitrogen and/or oxygen atoms. The polyhydroxyl compounds generally may contain one or more oxyalkylene groups and, thus, the polyhydroxyl compounds include compounds such as polyetherpolyols. The number of carbon atoms (i.e., carbon number, wherein the term carbon number as used throughout this application refers to the total number of carbon atoms in either the acid or alcohol as the case may be) and number of hydroxy groups (i.e., hydroxyl number) contained in the polyhydroxyl compound used to form the carboxylic esters may vary over a wide range.

The following alcohols are particularly useful as polyols: neopentyl glycol, trimethylolethane, trimethylolpropane, trimethylolbutane, mono-pentaerythritol, technical grade pentaerythritol, and di-pentaerythritol. The most preferred alcohols are technical grade (e.g., approximately 88% mono-, 10% di- and 1–2% tri-pentaerythritol) pentaerythritol, monopentaerythritol, di-pentaerythritol, and trimethylolpropane.

Polybasic Acids

Selected polybasic or polycarboxylic acids include any $C_2$ to $C_{12}$ diacids, e.g., adipic, azelaic, sebacic and dodecanedioic acids.

Anhydrides

Anhydrides of polybasic acids can be used in place of the polybasic acids, when esters are being formed. These include succinic anhydride, glutaric anhydride, adipic anhydride, maleic anhydride, phthalic anhydride, nadic anhydride, methyl nadic anhydride, hexahydrophthalic anhydride, and mixed anhydrides of polybasic acids.

The lubricating oils contemplated for use with the complex alcohol ester compositions of the present invention include natural oils, synthetic oils and hydrocarbon-based oils of lubricating viscosity and mixtures thereof. The synthetic oils include long chain alkanes such as cetanes and olefin polymers such as oligomers of hexene, octene, decene, and dodecene, etc. The other synthetic oils include (1) fully esterified ester oils, with no free hydroxyls, such as pentaerythritol esters of monocarboxylic acids having 2 to 20 carbon atoms, trimethylol propane esters of monocarboxylic acids having 2 to 20 carbon atoms, (2) polyacetals and (3) siloxane fluids. Especially useful among the synthetic esters are those made from polycarboxylic acids and monohydric alcohols.

In some of the lubricant formulations set forth above a solvent may be employed depending upon the specific application. Solvents that can be used include the hydrocarbon solvents, such as toluene, benzene, xylene, and the like.

The formulated lubricant according to the present invention preferably comprises about 60–99% by weight of a blend of complex alcohol ester and at least one additional basestock selected from natural, hydrocarbon-based and synthetic oils, about 1 to 20% by weight lubricant additive package, and about 0 to 20% by weight of a solvent.

Two-Cycle Engine Oils

The basestock blends can be used in the formulation of two-cycle engine oils. The preferred two-cycle engine oil is typically formulated using the basestock blend formed according to the present invention together with any conventional two-cycle engine oil additive package. The additives listed below are typically used in such amounts so as to provide their normal attendant functions.

The additive package may include, but is not limited to, viscosity index improvers, corrosion inhibitors, oxidation inhibitors, coupling agents, dispersants, extreme pressure agents, color stabilizers, surfactants, diluents, detergents and rust inhibitors, pour point depressants, antifoaming agents, and anti-wear agents.

The preferred two-cycle engine oil according to the present invention can employ typically about 75 to 85% basestock blend, about 1 to 5% solvent, with the remainder comprising an additive package.

Examples of the above additives for use in lubricants are set forth in the following documents which are incorporated herein by reference: U.S. Pat. No. 4,663,063 (Davis), which issued on May 5, 1987; U.S. Pat. No. 5,330,667 (Tiffany, III et al.), which issued on Jul. 19, 1994; U.S. Pat. No. 4,740,321 (Davis et al.), which issued on Apr. 26, 1988; U.S. Pat. No. 5,321,172 (Alexander et al.), which issued on Jun. 14, 1994; and U.S. Pat. No. 5,049,291 (Miyaji et al.), which issued on Sep. 17, 1991.

One such biodegradable two-cycle engine oil comprises: (a) a blended lubricating oil basestock which comprises: (1) between about 3–10 wt. % of a complex alcohol ester which comprises the reaction product of: a polyhydroxyl compound represented by the general formula:

$$R(OH)_n$$

wherein R is any aliphatic or cyclo-aliphatic hydrocarbyl group and n is at least 2, provided that the hydrocarbyl group contains from about 2 to 20 carbon atoms; a polybasic acid or an anhydride of a polybasic acid, and a branched and/or linear monohydric alcohol, provided that the alcohol is added in an amount which is less than 20% excess and wherein the concentration of the polybasic acid ester is less than or equal to 70 wt. %, based on the complex alcohol ester; and (2) between about 90–97 wt. % of at least one additional basestock, wherein the lubricating basestock oil exhibits the following properties: lubricity, as measured by the coefficient of friction, of less than or equal to 0.1; a pour point of less than or equal to −30° C.; biodegradability of greater than 60% in 28 days as measured by the Modified Sturm test; an aquatic toxicity of greater than 1,000 ppm; no volatile organic components; and thermal/oxidative stability as measured by HPDSC at 220° C. and 3.445 MPa air of greater than 10 minutes in the presence of 0.5 wt. % of an antioxidant; and (b) a lubricant additive package preferably comprising at least one additive selected from the group consisting of: viscosity index improvers, corrosion inhibitors, oxidation inhibitors, coupling agents, dispersants, extreme pressure agents, color stabilizers, surfactants, diluents, detergents and rust inhibitors, pour point depressants, antifoaming agents, and antiwear agents.

One preferred additional basestock is a biodegradable synthetic ester basestock which comprises the reaction product of: a branched or linear alcohol having the general formula $R(OH)_n$, wherein R is an aliphatic or cyclo-aliphatic group having from about 2 to 20 carbon atoms and n is at least 2; and mixed acids comprising about 30 to 80 molar %, preferably 35 to 55 molar %, of a linear acid having a carbon number in the range between about $C_5$ to $C_{12}$, preferably between about $C_7$ to $C_{10}$, and about 20 to 70 molar %, preferably 35 to 55 molar %, of at least one branched acid having a carbon number in the range between about $C_5$ to $C_{13}$; wherein the ester basestock exhibits the following properties: at least 60% biodegradation in 28 days as measured by the Modified Sturm test; a pour point of less than −25° C.; a viscosity of less than 7500 cps at −25° C.; and oxidative stability of up to 10 minutes as measured by HPDSC.

The biodegradable synthetic ester basestock preferably comprises multiple isomers, i.e., at least 3 isomer or more, preferably greater than 3 to 5 isomers. The branched acid is predominantly a doubly branched or an alpha branched acid having an average branching per molecule in the range between about 0.3 to 1.9. Moreover, the branched acid is at least one acid selected from the group consisting of: 2-ethylhexanoic acids, isoheptanoic acids, isooctanoic acids, isononanoic acids, and isodecanoic acids.

Another preferred biodegradable two-cycle lubricant oil comprises: 0–10 wt. % of diisooctyladipate (DIOA), 5–15 wt. % diisodecyladipate (DIDA), 10–20 wt. % diisotridecyladipate (DTDA), 40–60 wt. % of a biodegradable synthetic ester basestock which comprises the reaction product of: a branched or linear alcohol having the general formula $R(OH)_n$, wherein R is an aliphatic or cyclo-aliphatic group having from about 2 to 20 carbon atoms and n is at least 2; and mixed acids comprising about 30 to 80 molar % of a linear acid having a carbon number in the range between about $C_5$ to $C_{12}$, and about 20 to 70 molar % of at least one branched acid having a carbon number in the range between about $C_5$ to $C_{13}$, 5–15 wt. % of the complex alcohol ester according to the present invention, and 14–20 wt. % of a dispersant. This formulation exhibits a pour point less than about −35° C., a viscosity at −25° C. less than 7500 cps, a flash point of greater than about 200° C., a biodegradation greater than 60% in 28 days as measured by the Modified Sturm test, an aquatic toxicity of greater than 1,000 ppm, and pass the Yamaha Tightening Test for lubricity.

A preferred dispersant for two-cycle oil formulations comprises a major amount of at least one oil of lubricating viscosity and a minor amount of a functionalized and derivatized hydrocarbon; wherein functionalization comprises at least one group of the formula —CO—Y—$R^3$ wherein Y is O or S; $R^3$ is aryl, substituted hydrocarbyl, and —Y—$R^3$ has a pKa of 12 or less; wherein at least 50 mole % of the functional groups are attached to a tertiary carbon atom; and wherein said functionalized hydrocarbon is derivatized by a nucleophilic reactant. The nucleophilic reactant is selected from the group consisting of alcohols and amines.

EXAMPLE 1

Complex alcohol esters were made using both trimethylolpropane and technical grade pentaerythritol as the polyol, adipic acid as the polybasic acid and various $C_7$–$C_{13}$ monohydric alcohols, both linear and branched. During the reaction, the adipate di-ester was also formed. Some of these materials were wipefilmed to remove the adipate di-ester and some were not. The products were submitted for various tests.

One particularly surprising result was in regard to seal swell. Diisodecyladipate (DIDA) has been found to be particularly harsh on some seals. Samples containing as much as 40% DIDA demonstrated the same seal swell as samples of diisotridecyladipate (DTDA), which is used as a commercial lubricant today because of its low seal swell.

EXAMPLE 2

Table 1 below compares a variety of complex alcohol esters versus a conventional branched ester to demonstrate the increased biodegradability and thermal and oxidative stability of the complex alcohol esters according to the present invention.

TABLE 1

| Ester | Pour Point (° C.) | Viscosity at −25° C. (cps) | Viscosity at 40° C. (cSt) | Viscosity at 100° C. (cSt) | Viscosity Index | HPDSC OIT*** (min.) | Biodegradability (%) |
|---|---|---|---|---|---|---|---|
| TMP/AA/IDA | — | — | 165.7 | 21.31 | 152 | — | 67.23 |
| TMP/AA/n-C7* | −33 | 43500 | 155.6 | 18.22 | 131 | — | 80.88 |
| TPE/AA/IHA | — | — | 160.8 | 24.35 | 184 | 58.83 | 84.83 |
| TMP/iso-$C_{18}$ | −20 | 358000 | 78.34 | 11.94 | 147 | 4.29 | 63.32 |
| TMP/AA/n-C7** | −14 | solid | 27.07 | 5.77 | 163 | — | 78.84 |

**Complex alcohol ester made without stripping of the adipate
**This is a partial ester of TMP, adipic acid and a n-C7 acid wherein the adipate diester has been stripped out
***OIT denotes oxidation induction time (minutes until decomposition)
HPDSC denotes high pressure differential calorimetry
TMP is trimethylolpropane
AA is adipic acid
IDA is isodecyl alcohol
IHA is isohexyl alcohol
TPE is technical grade pentaerythritol
iso-$C_{18}$ is isostearate The branched acid ester and the complex alcohol ester formed without stripping exhibited undesirable pour points, i.e., −20 and −14° C., respectively, and undesirable viscosities at −25° C., i.e., 358,000 cps and a solid product, respectively.

EXAMPLE 3

Set forth below in Table 2 are various samples where the complex alcohol esters of the present invention were blended with various other polyol esters and then run through a Yamaha 2T test.

TABLE 2

(Lubricity Data)

| Ester Blend | Blend Ratio | Reference | Sample |
|---|---|---|---|
| TPE/C810/Ck8:TMP/7810 | 1:1 | 6.00 | 5.92 |
| TMP/AA/IDA:TMP/1770 | 2:3 | 5.54 | 5.18 |

C810 is a mixture of linear $C_8$ and $C_{10}$ acids.
Ck8 is an iso-octyl alcohol form from the cobalt oxo process.
7810 is a mixture of n-$C_7$, n-$C_8$, and n$C_{10}$ acids..
1770 is a 70:30 mixture of n-$C_7$ and α-branched $C_7$, respectively.

EXAMPLE 4

The samples set forth below in Table 3 demonstrate that complex alcohol esters can exhibit good biodegradability, especially complex alcohol esters blended with other basestocks.

TABLE 3

| Ester/ Ester Blend | Viscosity @ 40° C. | Percent Biodegradable (Modified Sturm) |
|---|---|---|
| TMP/AA/IDA | 56.89 | 65.21 |
| TMP/AA/IDA:TMP/1770 | 25.26 | 77.40 |
| TMP/AA/IDA:TMP/1770 + DI | 43.36 | 68.90 |
| TMP/AA/n-C7 alcohol | 27.07 | 78.84 |
| TMP/AA/n-C7 alcohol (bottoms) | 155.60 | 80.88 |
| TMP/AA/INA | 115.00 | 60.26 |
| TMP/AA/INA | 137.30 | 57.81 |

1770 denotes a 70:30 mixture of n-$C_7$ and α-branched $C_7$, respectively.
DI denotes dispersant additive package.
INA denotes isononyl alcohol.

EXAMPLE 5

Set forth below in Table 4 are various blends of two-cycle engine oils and their respective percent biodegradation and the Yamaha Two-Cycle Tightening Test.

TABLE 4

| Blended Sample | % Biodegradation | Yamaha 2T Tightening Test |
|---|---|---|
| TMP/AA/IDA | 65 | N/A - no dispersant |
| TMP/1770 | 76 | N/A - no dispersant |
| TMP/AA/IDA:TMP/1770 (60:40) | 77 | N/A - no dispersant |
| TMP/AA/IDA + Adpack | 55 (est.) | N/A - too thick |
| TMP/1770 + Adpack | 65 (est.) | Fail |
| TMP/AA/IDA:TMP/1770 + Adpack | 69 | Pass |
| TMP/AA/IDA + Adpack | 55 (est.) | N/A - too thick |
| TMP/C810/Ck8 + Adpack | 62 | Fail |
| DTDA + Adpack | 51 (est.) | Fail |
| TMP/AA/IDA:TPE/C810/Ck8: DTDA + Adpack | 60.3 | Pass |

C810 is a mixture of linear $C_8$ and $C_{10}$ acids.
Ck8 is an iso-octyl alcohol form from the cobalt oxo process.
1770 is a 70:30 mixture of n-$C_7$ and α-branched $C_7$, respectively.
TMP is trimethylolpropane
AA is adipic acid
IDA is isodecyl alcohol
DTDA is diisotridecyladipate
TPE is technical grade pentaerythritol As is clearly demonstrated in the above comparative data, the synergistic blends of TMP/AA/IDA (i.e., a complex alcohol ester) and a partially branched TMP/1770 ester in a ratio of 60:40 easily met a biodegradability level of greater than 60% in 28 days as measured by the Modified Sturm test. Furthermore, when a conventional two-cycle additive package (Adpack) was added to this blend it readily passed the Yamaha 2T Tightening Test.

What is claimed is:

1. A biodegradable lubricating oil comprising an add mixture of the following components:

(A) a complex alcohol ester basestock which is a reaction product of an add mixture of the following: (1) a polyhydroxyl compound selected from the group consisting of neopentyl glycol, technical grade pentaerythritol, mono-pentaerythritol, di-pentaerythritol, trimethylolpropane, trimethylolethane and trimethylolbutane; (2) a polybasic acid or an anhydride of a polybasic acid, providing that the ratio of equivalents of said polybasic acid to equivalents of alcohol from said polyhydroxyl compound is in the range between about 1.6:1 to 2:1; and (3) a monohydric alcohol, provided that the radio of equivalents of said monohydric alcohol to equivalents of said polybasic acid is in the range between about 0.84:1 to 1.2:1; wherein said complex alcohol ester exhibits a viscosity in the range between about 100–700 cSt at 40° C. and has a polybasic acid ester concentration of less than or equal to 70 wt. %, based on said complex alcohol ester; and (B) at least one additional basestock, wherein said biodegradable lubricating oil exhibits biodegradability of greater than 60% as measured by the Sturm test.

2. The biodegradable lubricating oil according to claim 1 wherein said complex alcohol ester basestock is added in an amount such that said biodegradable lubricating oil exhibits a lubricity, as measured by the coefficient of friction, of less than or equal to 0.15.

3. The biodegradable lubricating oil according to claim 1 wherein said complex alcohol ester exhibits the following properties: lubricity, as measured by the coefficient of friction, of less than or equal to 0.1; a pour point of less than or equal to −30° C.; no volatile organic components; and thermal/oxidative stability as measured by HPDSC at 220° C. and 3.445 MPa air of greater than 10 minutes with 0.5 wt. % of an antioxidant.

4. The biodegradable lubricating oil according to claim 1 wherein said biodegradable lubricating oil passes the Yamaha Tightening Test, exhibits a FZG of greater than about 12, and/or exhibits a wear scar diameter of less than or equal to 0.45 millimeters.

5. The biodegradable lubricating oil according to claim 1 wherein said additional basestock is selected from the group consisting of: natural oils, hydrocarbon-based oils and synthetic oils.

6. The biodegradable lubricating oil according to claim 5 wherein said mineral oils are at least one oil selected from the group consisting of: rapeseed oils, canola oils and sunflower oils; said hydrocarbon-based oils are at least one oil selected from the group consisting of: mineral oils and highly refined mineral oils; and said synthetic oils are at least one oil selected from the group consisting of: poly alpha olefins, polyalkylene glycols, polyisobutylenes, phosphate esters, silicone oils, diesters, polyol esters, and other synthetic esters.

7. The biodegradable lubricating oil according to claim 5 wherein said complex alcohol ester is present in an amount between about 3–10 wt. % and said additional basestock is present in an amount between about 90–97 wt. %.

8. The biodegradable lubricating oil basestock according to claim 7 wherein said complex alcohol ester is present in an amount between about 6 to 10 wt. % and said additional basestock is present in an amount between about 90 to 94 wt. %.

9. The biodegradable lubricating oil according to claim 3 wherein said complex alcohol ester has a pour point of less than or equal to −40° C.

10. The biodegradable lubricating oil according to claim 1 wherein said polyhydroxyl compound is at least one compound selected from the group consisting of: technical grade pentaerythritol and mono-pentaerythritol, and the ratio of equivalents of said polybasic acid to equivalents of alcohol from said polyhydroxyl compound is in the range between about 1.75:1 to 2:1.

11. The biodegradable lubricating oil according to claim 1 wherein said polyhydroxyl compound is at least one compound selected from the group consisting of: trimethylolpropane, trimethylolethane and trimethylolbutane, and the ratio of equivalents of said polybasic acid to equivalents of alcohol from said polyhydroxyl compound is in the range between about 1.6:1 to 2:1.

12. The biodegradable lubricating oil according to claim 1 wherein said polyhydroxyl compound is di-pentaerythritol and the ratio of equivalents of said polybasic acid to equivalents of alcohol from said polyhydroxyl compound is in the range between about 1.83:1 to 2:1.

13. The biodegradable lubricating oil according to claim 1 wherein viscosity of said complex alcohol ester is in the range between about 100–200 at 40° C.

14. The biodegradable lubricating oil according to claim 1 wherein said monohydric alcohol may be at least one alcohol selected from the group consisting of: branched and linear $C_5$ to $C_{13}$ alcohol.

15. The biodegradable lubricating oil according to claim 14 wherein said linear monohydric alcohol is present in an amount between about 0 to 30 mole %.

16. The biodegradable lubricating oil according to claim 15 wherein said linear monohydric alcohol is present in an amount between about 5 to 20 mole %.

17. The biodegradable lubricating oil according to claim 14 wherein said monohydric alcohol is at least one alcohol selected from the group consisting of: $C_8$ to $C_{10}$ iso-oxo alcohols.

18. The biodegradable lubricating oil according to claim 17 wherein said polybasic acid is adipic acid and said monohydric alcohol is either isodecyl alcohol or 2-ethylhexanol.

19. The biodegradable lubricating oil according to claim 1 wherein said complex alcohol ester exhibits at least one of the properties selected from the group consisting of:

(a) a total acid number of less than or equal to about 1.0 mgKOH/gram, (b) a hydroxyl number in the range between about 0 to 50 mgKOH/gram, (c) a metal catalyst content of less than about 25 ppm, (d) a molecular weight in the range between about 275 to 250,000 Daltons, (e) a seal swell equal to about diisotridecyladipate, (f) a viscosity at −25° C. of less than or equal to about 100,000 cps, (g) a flash point of greater than about 200° C., (h) aquatic toxicity of greater than about 1,000 ppm, (i) a specific gravity of less than about 1.0, and (j) a viscosity index equal to or greater than about 150.

20. The biodegradable lubricating oil according to claim 5 wherein said synthetic oil is a biodegradable synthetic ester basestock which comprises the reaction product of: a branched or linear alcohol having the general formula $R(OH)_n$, wherein R is an aliphatic or cyclo-aliphatic group having from about 2 to 20 carbon atoms and n is at least 2; and mixed acids comprising about 30 to 80 molar % of a linear acid having a carbon number in the range between about $C_5$ to $C_{12}$, and about 20 to 70 molar % of at least one branched acid having a carbon number in the range between about $C_5$ to $C_{13}$.

21. A biodegradable two-cycle lubricant which comprises said lubricating oil of claim 1 and a lubricant additive package.

22. The biodegradable two-cycle lubricant according to claim 21 wherein said additive package comprises at least one additive selected from the group consisting of: viscosity index improvers, corrosion inhibitors, oxidation inhibitors, coupling agents, dispersants, extreme pressure agents, color stabilizers, surfactants, diluents, detergents and rust inhibitors, pour point depressants, antifoaming agents, and anti-wear agents.

23. The biodegradable two-cycle lubricant according to claim 22 wherein said dispersant comprises a major amount of at least one oil of lubricating viscosity and a minor amount of a functionalized and derivatized hydrocarbon; wherein functionalization comprises at least one group of the formula —CO—Y—$R^3$ wherein Y is O or S; $R^3$ is aryl, substituted hydrocarbyl, and —Y—$R^3$ has a pKa of 12 or less; wherein at least 50 mole % of the functional groups are attached to a tertiary carbon atom; and wherein said functionalized hydrocarbon is derivatized by a nucleophilic reactant.

24. The biodegradable two-cycle lubricant according to claim 23 wherein said nucleophilic reactant is selected from the group consisting of alcohols and amines.

25. The biodegradable two-cycle lubricant according to claim 21 wherein said lubricant comprises about 75 to 85% said lubricating oil basestock, about 1 to 5% solvent, with the remainder comprising said additive package.

26. The biodegradable two-cycle lubricant according to claim 21 wherein said lubricant comprises the following formulation:

0–10 wt. % of diisooctyladipate;

5–15 wt. % diisodecyladipate;

10–20 wt. % diisotridecyladipate;

40–60 wt. % of a biodegradable synthetic ester basestock which comprises the reaction product of: a branched or linear alcohol having the general formula $R(OH)_n$, wherein R is an aliphatic or cyclo-aliphatic group having from about 2 to 20 carbon atoms and n is at least 2; and mixed acids comprising about 30 to 80 molar % of a linear acid having a carbon number in the range between about $C_5$ to $C_{12}$, and about 20 to 70 molar % of at least one branched acid having a carbon number in the range between about $C_5$ to $C_{13}$;

5–15 wt. % of said complex alcohol ester; and

14–20 wt. % of said additive package.

27. A hydrocarbon fuel which comprises an add mixture of the following components:

a motor gasoline;

a biodegradable lubricating oil which comprises an add mixture of: (1) a complex alcohol ester basestock which comprises the reaction product of an add mixture of the following: (a) a polyhydroxyl compound represented by the general formula:

$$R(OH)_n$$

wherein R is any aliphatic or cyclo-aliphatic hydrocarbyl group and n is at least 2, provided that said hydrocarbyl group contains from about 2 to 20 carbon atoms; (b) a polybasic acid or an anhydride of a polybasic acid, provided that the ratio of equivalents of said polybasic acid to equivalents of alcohol from said polyhydroxyl compound is in the range between about 1.6:1 to 2:1; and (c) a monohydric alcohol, provided that the ratio of equivalents of said monohydric alcohol to equivalents of said polybasic acid is in the range between about 0.84:1 to 1.2:1; wherein said complex alcohol ester exhibits a viscosity in the range between about 100–700 cSt at 40° C. and has a polybasic acid ester concentration of less than or equal to 70 wt. %, based on said complex alcohol ester; and (2) at least one additional basestock, wherein said biodegradable lubricating oil exhibits biodegradability of greater than 60% as measured by the Sturm test; and an additive package.

28. The hydrocarbon fuel according to claim 27 wherein said complex alcohol ester basestock is added in an amount such that said biodegradable lubricating oil exhibits a lubricity, as measured by the coefficient of friction, of less than or equal to 0.15.

29. The hydrocarbon fuel according to claim 27 wherein said additional basestock is selected from the group consisting of: natural oils, hydrocarbon-based oils and synthetic oils.

30. The hydrocarbon fuel according to claim 29 wherein said mineral oils are at least one oil selected from the group consisting of: rapeseed oils, canola oils and sunflower oils; said hydrocarbon-based oils are at least one oil selected from the group consisting of: mineral oils and highly refined mineral oils; and said synthetic oils are at least one oil selected from the group consisting of: poly alpha olefins, polyalkylene glycols, polyisobutylenes, phosphate esters, silicone oils, diesters, polyol esters, and other synthetic esters.

31. The hydrocarbon fuel according to claim 27 wherein said polyhydroxyl compound is at least one compound selected from the group consisting of: technical grade pentaerythritol and mono-pentaerythritol, and the ratio of equivalents of said polybasic acid to equivalents of alcohol from said polyhydroxyl compound is in the range between about 1.75:1 to 2:1.

32. The hydrocarbon fuel according to claim 27 wherein said polyhydroxyl compound is at least one compound selected from the group consisting of: trimethylolpropane, trimethylolethane and trimethylolbutane, and the ratio of equivalents of said polybasic acid to equivalents of alcohol from said polyhydroxyl compound is in the range between about 1.6:1 to 2:1.

33. The hydrocarbon fuel according to claim 27 wherein said polyhydroxyl compound is di-pentaerythritol and the ratio of equivalents of said polybasic acid to equivalents of alcohol from said polyhydroxyl compound is in the range between about 1.83:1 to 2:1.

34. The hydrocarbon fuel according to claim 27 wherein said additive package comprises at least one additive selected from the group consisting of: viscosity index improvers, corrosion inhibitors, oxidation inhibitors, coupling agents, dispersants, extreme pressure agents, color stabilizers, surfactants, diluents, detergents and rust inhibitors, pour point depressants, antifoaming agents, and anti-wear agents.

35. The hydrocarbon fuel according to claim 29 wherein said synthetic oil is a biodegradable synthetic ester basestock which comprises the reaction product of: a branched or linear alcohol having the general formula $R(OH)_n$, wherein R is an aliphatic or cyclo-aliphatic group having from about 2 to 20 carbon atoms and n is at least 2; and mixed acids comprising about 30 to 80 molar % of a linear acid having a carbon number in the range between about $C_5$ to $C_{12}$, and about 20 to 70 molar % of at least one branched acid having a carbon number in the range between about $C_5$ to $C_{13}$.

* * * * *